United States Patent [19]

Weitz

[11] Patent Number: 4,808,446

[45] Date of Patent: Feb. 28, 1989

[54] ARTIFICIAL GRASSY PLANT

[76] Inventor: Henry Weitz, Prosperity House, 8A Granville Road, Kowloon, Hong Kong

[21] Appl. No.: 168,144

[22] Filed: Mar. 15, 1988

[51] Int. Cl.[4] ..... A41G 1/00

[52] U.S. Cl. ..... 428/17; 428/24

[58] Field of Search ..... 428/4, 17, 25, 26, 24; 405/24

[56] References Cited

U.S. PATENT DOCUMENTS

| | | | |
|---|---|---|---|
| 2,810,977 | 10/1957 | Barry | 428/4 |
| 3,525,660 | 8/1970 | Kerrigan | 428/26 |
| 3,726,096 | 4/1973 | Bahre | 405/24 |
| 3,759,769 | 9/1973 | Oshima | 428/17 X |
| 4,055,840 | 10/1977 | Uchytil et al. | 428/4 X |
| 4,201,806 | 5/1980 | Cole | 428/4 |
| 4,221,500 | 9/1980 | Garrett | 428/17 X |

FOREIGN PATENT DOCUMENTS

| | | | |
|---|---|---|---|
| 722643 | 1/1932 | France | 428/916 |

*Primary Examiner*—Henry F. Epstein
*Attorney, Agent, or Firm*—Alvin Sinderbrand

[57] ABSTRACT

An artificial grassy plant is comprised of a die-cut synthetic sheet member having a series of substantially parallel blade-like leaf portions integral, at one end, with a transverse connecting strip and extending substantially perpendicular to the latter, a tubular connector open at least at one of its ends, an adhesive strip as least as long as the transverse connecting strip and being adhesively secured along the latter with the transverse connecting strip and the adhesive strip being wound together about the tubular connector and secured on the latter by the adhesive strip so that the blade-like leaf portions are bunched together at one end about the tubular connector and extend therefrom in a substantially erect formation, and an elongated stem member inserted in the tubular connector through the open end of the latter for mounting the bunched together blade-like leaf portions on the stem member.

5 Claims, 2 Drawing Sheets

FIG. 1
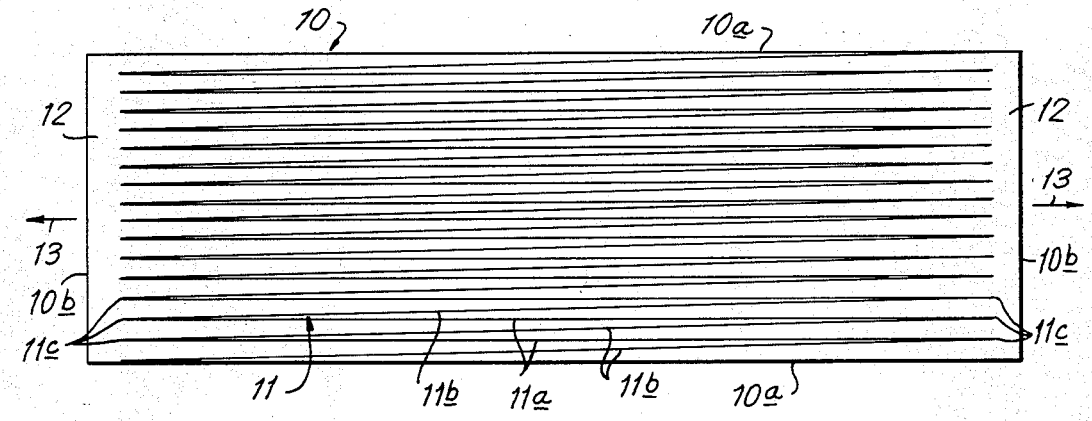
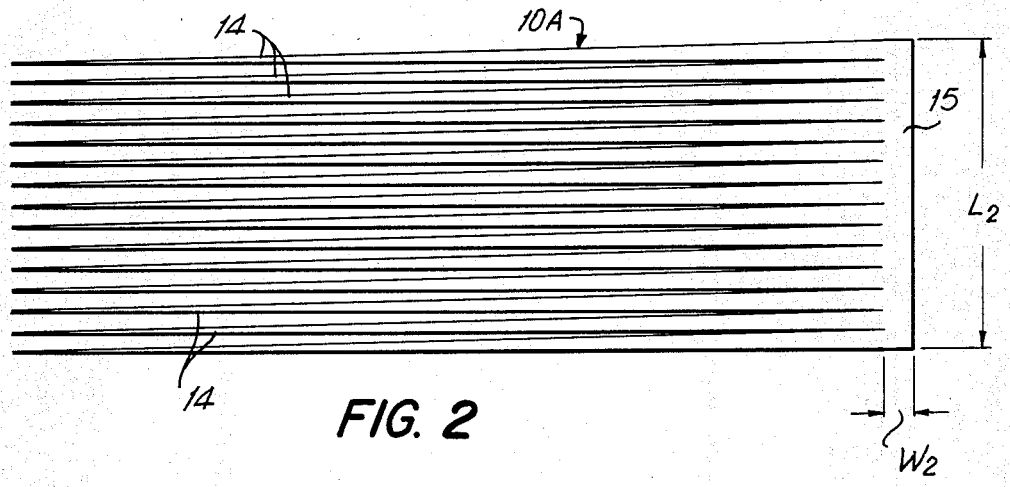
FIG. 2
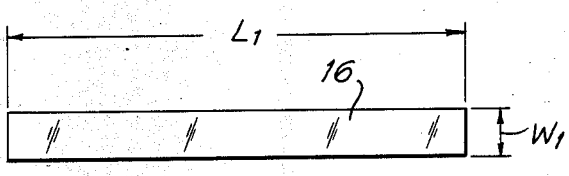
FIG. 3
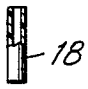
FIG. 4
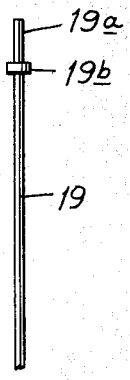
FIG. 5

ARTIFICIAL GRASSY PLANT

BACKGROUND OF THE INVENTION

1. Field of the Invention

This invention relates generally to artificial plants and, more particularly, is directed to improvements in artificial grassy plants or the like having blade-like leaf portions.

2. Description of the Prior Art

It is known in the prior art to provide an artificial grassy plant formed of a number of blade-like leaf portions of vinyl or other synthetic sheet material which, at their lower ends, are bunched together about a supporting stem member of wire, plastic or wire-reinforced plastic, and secured to such stem by means of an adhesive strip or length of malleable wire wound about the bunched together lower end portions of the blade-like leaf members.

Further, it is known, for example, as disclosed in French Pat. No. 722,643, granted Aug. 18, 1934, to simultaneously form a large number of leaves or petals of an artificial plant or flower by cutting a flexible sheet of fabric or the like along approximately parallel lines which extend a substantial part of the distance across the sheet so as to define a large number of petal or leaf portions integral, at one end, with a connecting strip whereupon such connecting strip is wrapped about the stem member of wire or the like and secured thereto by a malleable wire wrapping so that the petal or leaf portions are then arrayed about and extend from the supporting stem member. However, even in the foregoing known arrangement, the wrapping of the connecting strip about the supporting stem or wire and the secure attachment thereto requires considerable time, skill and manual dexterity, and it is difficult to provide a product of uniform high quality.

OBJECTS AND SUMMARY OF THE INVENTION

Accordingly, it is an object of this invention to provide an artificial grassy plant which avoids the above described disadvantages of the prior art and, more particularly, which can be easily and quickly assembled by relatively unskilled persons.

More specifically, it is an object of this invention to provide an artificial grassy plant, as aforesaid, of high quality and reliably consistent appearance even when assembled by relatively unskilled persons.

Another object of this invention is to provide an artificial grassy plant, as aforesaid, which is economical to produce.

In accordance with an aspect of this invention, an artificial grassy plant comprises a die-cut synthetic sheet member, for example, of vinyl or the like, having a series of substantially parallel blade-like leaf portions integral, at one, with a transverse connecting strip portion and extending substantially parallel to the latter, a tubular connector open at least at one end, an adhesive strip at least as long as the transverse connecting portion and being adhesively secured along the latter, with the transverse connecting strip portion and the adhesive strip secured therealong being wound about the tubular connector and secured on the latter by the adhesive strip so that the blade-like leaf portions are bunched together at one end about the tubular connector and extend from the latter in a substantially erect formation, and an elongated stem member inserted in the tubular connector through the lower open end for mounting the erect formation of bunched together blade-like leaf portions on the stem member.

In the case where the adhesive strip has an adhesive coating on a surface thereof facing inwardly toward the tubular connector as wound about the latter with the transverse connecting strip portion, the adhesive strip desirably extends laterally beyond the connecting strip portion in the direction away from the blade-like leaf portions for securing contact of the adhesive coating with the tubular connector and with the successive turns of the adhesive strip. Further, the adhesive strip desirably extends longitudinally beyond the connecting strip portion so that the adhesive coating secures turns of the adhesive strip to the tubular connector and to each other upon winding about the tubular connector.

In accordance with another feature of this invention, the tubular connector is desirably open at both ends thereof, and a stem-like extension is inserted in the tubular connector through the end of the latter remote from the stem member, for example, for supporting a simulated flower, seed heads or the like, among the erect formation of blade-like leaf portions.

The above, and other objects, features and advantages of this invention, will be apparent in the following detailed description of an illustrative embodiment thereof which is to be read in connection with the accompanying drawings and in which corresponding parts are identified by the same reference numerals in the several views.

BRIEF DESCRIPTION OF THE DRAWINGS

FIG. 1 is a plan view of a sheet of synthetic material and shows a zig-zag pattern of lines along which the sheet is cut for forming blade-like leaf portions of an artificial grassy plant according to an embodiment of this invention;

FIG. 2 is a plan view of one of a pair of assemblies of blade-like leaf portions cut from the sheet of FIG. 1;

FIG. 3 is a plan view of an adhesive strip which is employed for securing the assembly of blade-like leaf portions of FIG. 2 in a bunched together erect formation;

FIG. 4 is an elevational view of a tubular connector included in an artificial grassy plant according to this invention, and which is shown partly broken away and in section;

FIG. 5 is an elevational view of an upper end portion of a stem member included in an artificial grassy plant embodying this invention;

DESCRIPTION OF A PREFERRED EMBODIMENT

Figure 6:
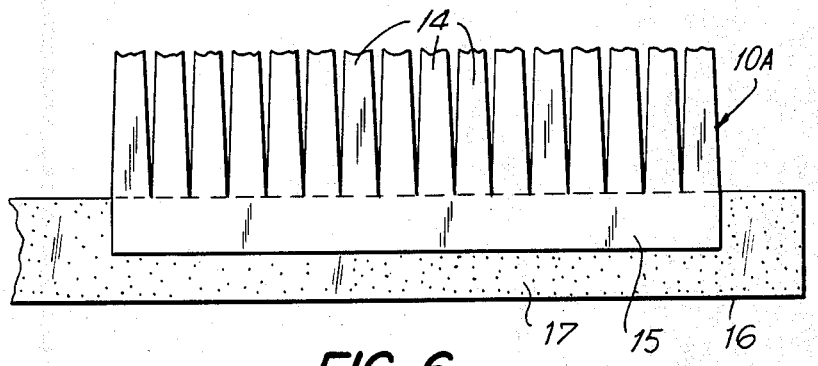
FIG. 6 is an enlarged fragmentary sectional view illustrating the manner in which the adhesive strip of FIG. 3 is initially secured to the assembly of blade-like leaf portions shown in FIG. 2.

Referring initially to FIG. 1, it will be seen that, in producing artificial grassy plants according to an embodiment of this invention, a substantially rectangular sheet 10 of vinyl or other suitable synthetic material is cut along a pattern 11 of zig-zag lines. As shown, the pattern 11 is comprised of a first series of parallel, laterally spaced apart lines 11*a* extending longitudinally along the rectangular sheet 10 and alternating with a second series of parallel, similary laterally spaced apart lines 11*b* extending longitudinally along the sheet 10. Further, as shown, the lines 11*a* and 11*b* are slightly skewed or angled in opposite directions relative to the longitudinal side edges 10*a* of the rectangular sheet 10 so that adjacent lines 11*a* and 11*b* converge in respect to each other and intersect at their adjacent ends, as at the points 11*c* spaced uniformally from the adjacent end edges 10*b* of the rectangular sheet 10. Thus, the sheet 10 is left with uncut end portions 12 extending thereacross. It will apparent that the cutting of the sheet 10 along the zig-zag line pattern 11 can be conveniently and economically effected in a die-cutting operation.

At the completion of such die-cutting operation, the uncut end portions 12 of the sheet can be pulled apart in the direction of the arrows 13 on FIG. 1 so as to separate the cut sheet 10 into two blade-like leaf assemblies, one of which is generally indicated at 10A on FIG. 2. Such assembly 10A is shown to comprise a series of substantially parallel tapering blade-like leaf portions 14 integral, at one end, with a transverse connecting strip portion 15 and extending substantially perpendicular to the latter.

An adhesive strip 16 (FIG. 3) which is preferably transparent may have an adhesive coating 17 (FIGS. 6 and 7) on only one surface of the strip. In that case, the length $L_1$ and width $W_1$ of the adhesive strip 16 (FIG. 3) are preferably larger than the length $L_2$ and width $W_2$, respectively, of the connecting strip portion 15 (FIG. 2). In using the adhesive strip 16, the latter is secured by adhesive coating 17 along the connecting strip portion 15 as shown on FIG. 6, so that the adhesive strip 16 extends laterally beyond the connecting strip portion 15 in the direction away from the blade-like leaf portions 14, and further so that the end portions of the adhesive strip 16 extend longitudinally beyond the adjacent ends of the connecting strip portion 15. Thus, the parts of the adhesive coating 17 extending beyond connecting strip portion 15 remain exposed.

As shown on FIG. 4, an artificial grassy plant according to an embodiment of this invention includes a tubular connector 18 desirably formed of a length of substantially rigid plastic tubing and being open at its opposite ends.

Figure 7:
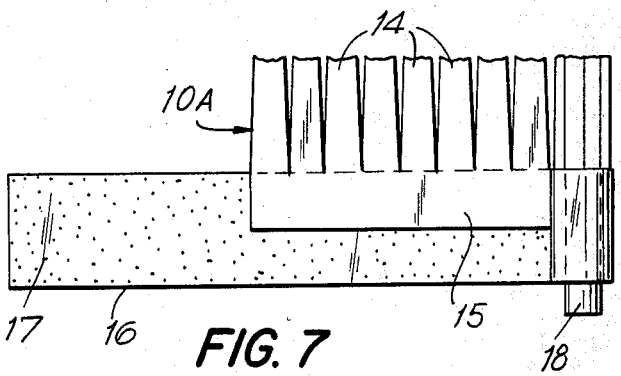
FIG. 7 is a view similar to that of FIG. 6, but showing the manner in which the assembly of blade-like leaf portions, with the adhesive strip secured thereto, is wound about the tubular connector of FIG. 4.
Figure 8:
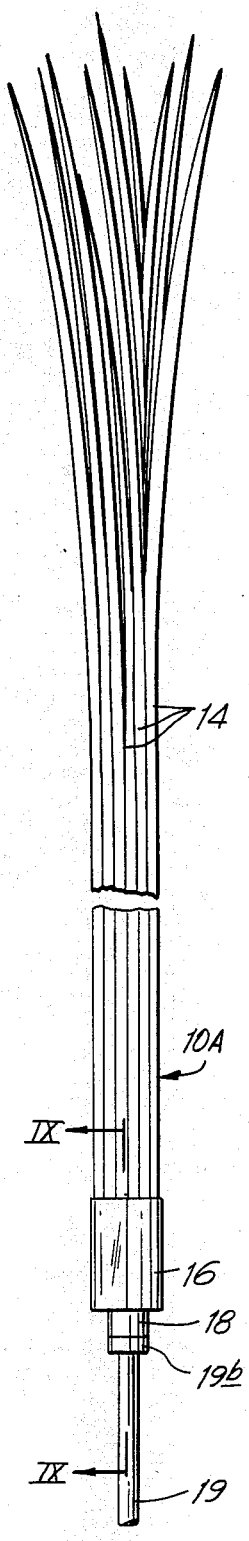
FIG. 8 is an elevational view of the assembled artificial grassy plant according to an embodiment of the invention, with an erect formation of bunched together blade-like leaf portions being broken away, and thus shortened, at locations intermediate the lengths thereof for convenience in illustration.

In accordance with the present invention, and as illustrated particularly on FIG. 7, the adhesive strip 16 secured along the transverse connecting strip portion 15 of the leaf assembly 10A and having the exposed parts of its adhesive coating 17 facing toward the tubular connector 18 is wound about the tubular connector 18 starting at one end of the adhesive strip. As such winding continues, the blade-like leaf portions 14 are bunched together about the tubular connector 18 at the ends of the leaf portions 14 extending from the connecting strip 15, and finally the trailing end portion of the adhesive strip 16 forms one or more outer turns which are coherent for finishing off the assembly of leaf portions, as shown on FIG. 8. It will be seen that the bunched together blade-like leaf portions 14 thus secured, at their lower ends, about the tubular connector 18 extend from the latter in a substantially erect formation, and are free to splay apart at their upper end portions, as shown on FIG. 8.

Figure 9:
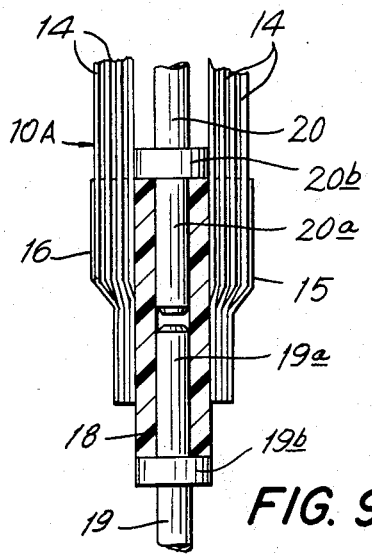
FIG. 9 is an further enlarged, fragmentary sectional view taken along the line IX—IX on FIG. 8.

The artificial grassy plant according to the illustrated embodiment of this invention further comprises an elongated stem member 19 preferably of plastic which may envelope a reinforcing wire, and which is dimensioned, at least at its upper end portion 19*a* (FIG. 5) for snug axial insertion into the open lower end of the tubular connector 18 (FIG. 9). The stem member 19 is desirably formed with a collar or flange 19*b* for defining the length of upper end portion 19*a* of the stem member insertable into the tubula connector 18. Preferably, and as shown particularly on FIG. 9, the lower end portion of the tubular connector 18 extends a small distance downwardly from the adhesive strip 17 and connecting strip portion 15 wrapped about the tubular connector so as to ensure that the opening at the lower end of the tubular connector 18 will not be obstructed and the end portion 19*a* of the stem member will be easily insertable therein.

Further, as shown, the end portion 19*a* of the stem member 19 desirably has a length approximately one half the length of the tubular connector 18 so that, with the end portion 19*a* of the stem member fully inserted in the tubular connector 18, the upper half of the interior of the tubular connector 18 remains available to receive an end portion 20*a* of a stem-like extension 20 inserted through the open upper end of the tubular connector 18. The stem-like extension 20 is desirably also formed with a collar or flange 20*b* engageable with the upper end of tubular connector 18 for limiting the axial extension of the end portion 20*a* into the tubular connector. The stem-like extension 20 is adapted to support, at its upper end, a simulated flower, seed heads or the like (not shown) among the splayed apart upper end portions of the bunched together blade-like leaf portions 14 extending, in an erect formation, from the tubular connector 18 on stem member 19.

It will be appreciated that, by reason of the tubular connector 18, the connecting strip portion 15 of the leaf assembly 10A and the adhesive strip 16 secured therealong can be easily and accurately wound or rolled upon the surface of the tubular connector so as to conveniently and accurately bunch together the blade-like leaf portions 14. Further, by reason of such attachment of the leaf assembly 10A to the tubular connector 18, the reliable and easy connection of the erect formation of bunched together blade-like leaf portions 14 to the stem member 19 and also, if desired, to the stem-like extension 20 can be assured.

In the illustrated embodiment of the invention, the adhesive strip 16 has been assumed to have an adhesive coating 17 only on the surface thereof facing inwardly toward the tubular connector 18 as wound about the latter. However, if desired, the adhesive strip 16 may be provided with adhesive coatings on both surfaces. In that case, the adhesive strip 16 may be coextensive with the connecting strip portion 15 of the leaf assembly 10A and arranged at the inside of the latter so that, as the connecting strip portion 15 is wound about the tubular connector 18, the adhesive strip having adhesive coatings on its opposite surfaces will be operative to secure the connecting strip portion 15 to the tubular connector and also to secure successive turns of the connecting strip portion 15 to each other.

Although an illustrative embodiment of the invention and a particular modification thereof have been described in detail herein, it is to be understood that the invention is not limited to the foregoing, and that various other modifications and changes may be effected therein by one skilled in the art without departing from the scope or spirit of the invention as defined in the appended claims.

What is claimed is:

1. An artificial grassy plant comprising: a die-cut synthetic sheet member having a series of substantially parallel blade-like leaf portions integral, at one end, with a transverse connecting strip portion and extending substantially perpendicular to the latter; a tubular connector open at least at a lower end; an adhesive strip at least as long as said transverse connecting strip portion and being adhesively secured along the latter, said transverse connecting strip portion with said adhesive strip secured therealong being wound repeatedly about said tubular connector and secured on the latter by said adhesive strip with successive turns of said wound connecting strip portion and adhesive strip being conterminous and with said one end of each of said leaf portions being substantially at the level of the upper end of said tubular connector so that all of said blade-like leaf portions are bunched together at said one end about said tubular connector and extend from the latter in a substantially erect formation; and an elongated stem member inserted in said tubular connector through said lower open end for mounting said bunched together blade-like leaf portions on said stem member.

2. An artificial grassy plant according to claim 1; in which said adhesive strip has an adhesive coating on a surface thereof facing inwardly toward said tubular connector as wound about the latter with said transverse connecting strip portion, and said adhesive strip extends laterally beyond said connecting strip portion in the direction away from said blade-like leaf portions for securing contact of said adhesive coating with said tubular connector and with successive turns of the adhesive strip.

3. An artificial grassy plant according to claim 2; in which said adhesive strip extends longitudinally beyond said connecting strip portion so that said adhesive coating secures turns of said adhesive strip to said tubular connector and to each other upon winding about said tubular connector.

4. An artificial grassy plant according to claim 1; in which said tubular connector is open at both ends thereof; and further comprising a stem-like extension inserted in said tubular connector through the upper of said open ends of the latter for supporting a simulated flower among said blade-like leaf portions.

5. An artificial grassy plant according to claim 4; in which said elongated stem member and said stem-like extension each have a flange spaced from an end portion thereof for limiting the insertion of the latter into said tubular connector.

* * * * *